US007448351B2

(12) United States Patent
Mizuno

(10) Patent No.: US 7,448,351 B2
(45) Date of Patent: Nov. 11, 2008

(54) VALVE TIMING CONTROLLER

(75) Inventor: Daisuke Mizuno, Kariya (JP)

(73) Assignee: Denso Corporation (JP)

( * ) Notice: Subject to any disclaimer, the term of this patent is extended or adjusted under 35 U.S.C. 154(b) by 52 days.

(21) Appl. No.: 11/790,967

(22) Filed: Apr. 30, 2007

(65) Prior Publication Data

US 2007/0277759 A1 Dec. 6, 2007

(30) Foreign Application Priority Data

Jun. 5, 2006 (JP) ..... 2006-156689

(51) Int. Cl.
*F01L 1/34* (2006.01)

(52) U.S. Cl. ..... 123/90.15; 123/90.17; 701/105

(58) Field of Classification Search ..... 123/90.15, 123/90.16, 90.17, 90.18; 701/102, 105
See application file for complete search history.

(56) References Cited

U.S. PATENT DOCUMENTS 7,077,087 B2 7/2006 Tani 7,243,627 B2 * 7/2007 Izumi et al. ..... 123/90.17

FOREIGN PATENT DOCUMENTS

JP 06-253580 9/1994

* cited by examiner

*Primary Examiner*—Ching Chang
(74) *Attorney, Agent, or Firm*—Nixon & Vanderhye PC

(57) ABSTRACT

A valve timing controller includes a driving circuit, a control circuit, and a signal line. The driving circuit controls electricity applied to the electric motor according to a control signal, and generates a rotation-direction signal which indicates a rotation direction of the electric motor by a voltage level. The control circuit outputs the control signal which is generated according to the rotation-direction signal. The rotation-direction signal is transmitted from the driving circuit to the control circuit through the signal line. The driving circuit outputs the rotation-direction signal of high-level during a predetermined period after the control signal is outputted.

9 Claims, 6 Drawing Sheets

VALVE TIMING CONTROLLER

CROSS-REFERENCE TO RELATED APPLICATION

This application is based on Japanese Patent Application No. 2006-156689 filed on Jun. 5, 2006, the disclosure of which is incorporated herein by reference.

FIELD OF THE INVENTION

The present invention relates to a valve timing controller which adjusts valve timing of at least one of an intake valve and an exhaust valve.

BACKGROUND OF THE INVENTION

JP-2005-330956A (corresponding to U.S. Pat. No. 7,077,087B2) shows a valve timing controller which includes an electric motor, a drive circuit, and a control circuit. The control circuit generates a control signal according to a rotation direction of an electric motor. The drive circuit energizes the electric motor according to the control signal. A motor rotation signal indicative of a rotation direction of the motor is generated by the driving circuit and is outputted into the control circuit.

In a case that a break or a ground fault is occurred in a signal line through which a motor rotation signal is transmitted from the driving circuit to the control circuit, it might be possible that the control circuit does not recognize the rotation direction of the electric motor. If the control circuit erroneously recognizes the rotation direction and generates a control signal based on the erroneous rotation direction, it may cause a trouble in operating the engine.

SUMMARY OF THE INVENTION

The present invention has been made in view of the foregoing problem. It is an object of the present invention to provide a valve timing controller which has high reliability.

According to the present invention, the valve timing controller includes a driving circuit, a control circuit, and a signal line. The driving circuit controls electricity applied to the electric motor according to a control signal, and generates a rotation-direction signal which indicates a rotation direction of the electric motor by a voltage level. The control circuit outputs the control signal which is generated according to the rotation-direction signal. The rotation-direction signal is transmitted from the driving circuit to the control circuit through the signal line. The driving circuit outputs the rotation-direction signal of high-level during a predetermined period after the control signal is outputted. If there is a ground fault in the signal line, the rotation-direction signal of low-level is inputted into the control circuit even though the signal of high-level is outputted from the driving circuit.

DETAILED DESCRIPTION OF THE PREFERRED EMBODIMENTS

Figure 1:
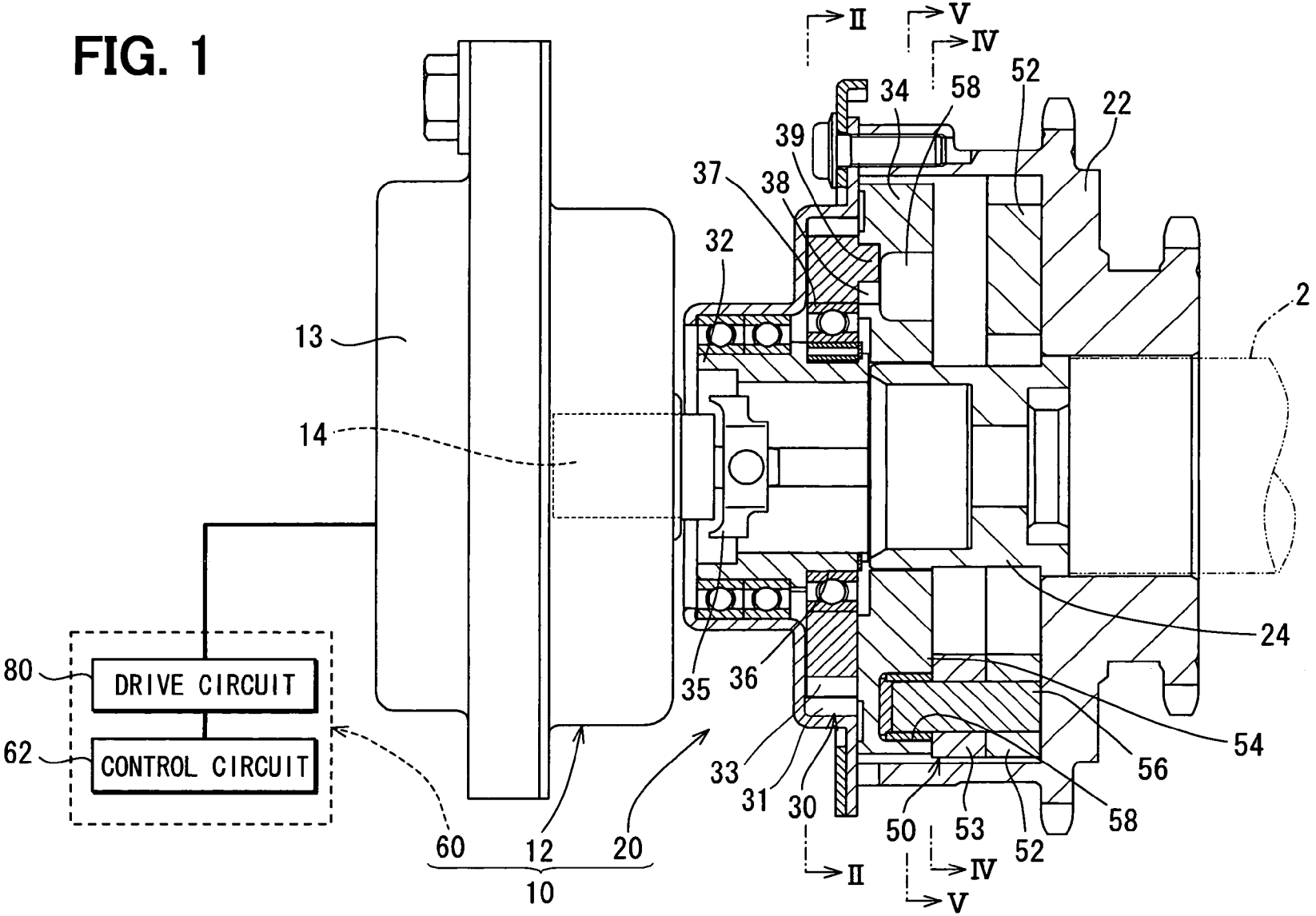
FIG. 1 is a cross sectional view showing a valve timing controller, taken along a line I-I in FIG. 4.

FIG. 1 is a cross sectional view of a valve timing controller 1. The valve timing controller 10 is provided in a torque transfer system which transfers the torque of a crankshaft (not shown) to a camshaft 2 of an engine. The valve timing controller 10 adjusts a valve timing of an intake valve or an exhaust valve by use of an electric motor 12.

The electric motor 12 is a brushless motor having a motor case 13, a motor shaft 14 and a coil (not shown). The motor case 13 is fixed on the engine through a stay (not shown). The motor case 13 supports the motor shaft 14 and accommodates the coil therein. When the coil of the motor 12 is energized, a rotating magnetic field is generated in a clockwise direction to rotate the motor shaft 14 in a normal direction. When the coil is energized to generate the rotating magnetic filed in counterclockwise direction, the motor shaft is rotated in a reverse direction.

Figure 3:
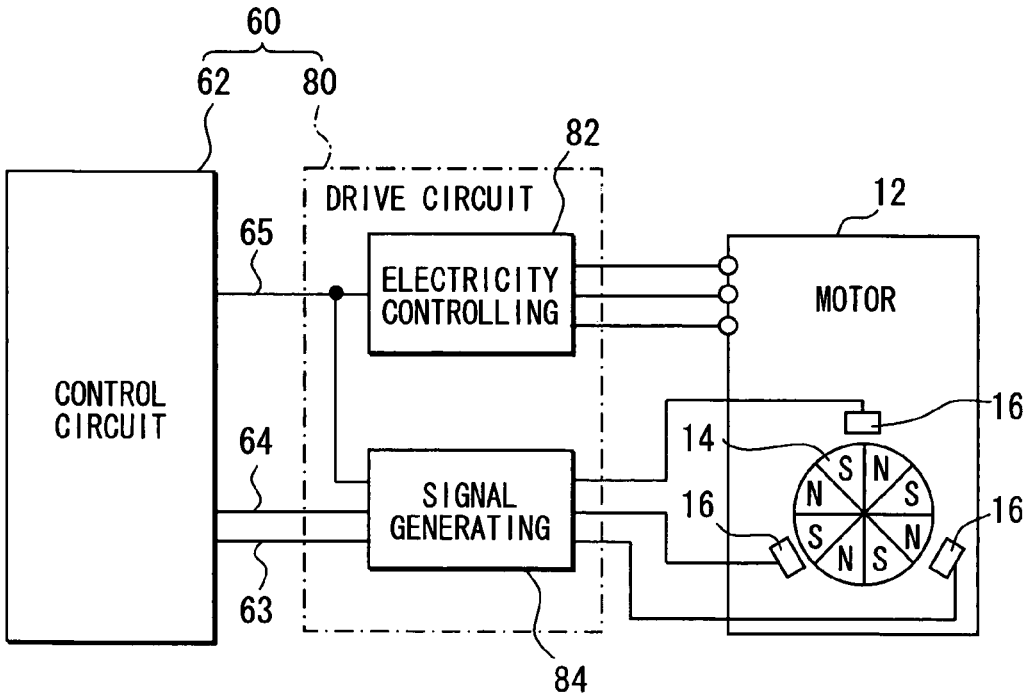
FIG. 3 is a block diagram showing an electric circuit.
Figure 8:
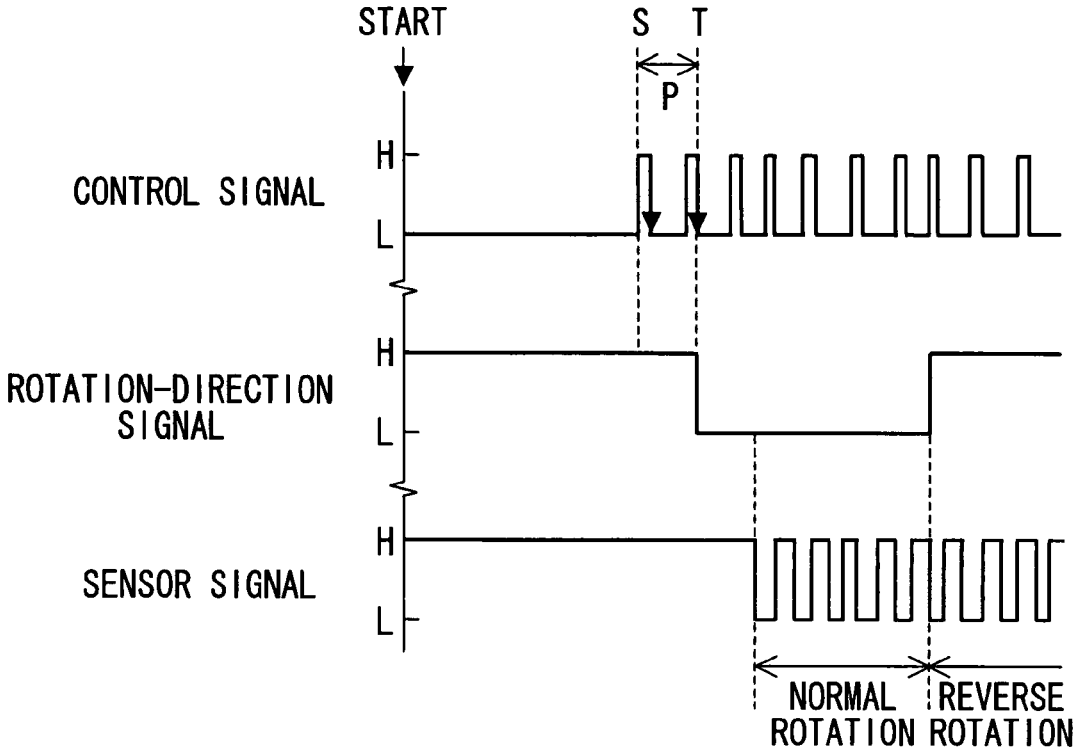
FIG. 8 is a time chart for explaining an operation of the electric circuit.

As shown in FIG. 3, the electric motor 12 is provided with rotation angle sensors 16. The rotation angle sensors 16 are Hall elements that are arranged around the motor shaft 14 at regular intervals. The rotation angle sensors 16 output sensor-signals of which voltage level is varied according to a rotational position of magnetic poles N, S of the motor shaft 14, as shown in FIG. 8.

Figure 2:
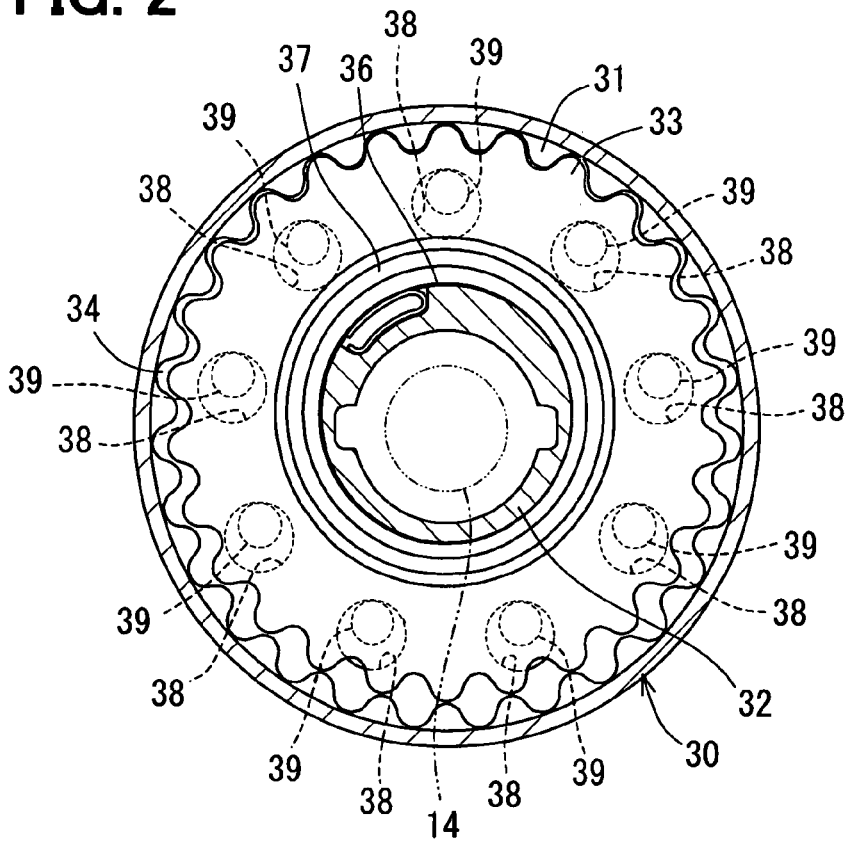
FIG. 2 is a cross sectional view taken along a line II-II in FIG. 1.

Referring to FIGS. 1 and 2, a phase-change unit 20 will be described hereinafter. The phase-change unit 20 includes a drive-rotation member 22, a driven-rotation member 24, a differential gear mechanism 30, and a link mechanism 50.

The drive-rotation member 22 is a timing sprocket around which a timing chain is wound to receive a driving force from a crankshaft of the engine. The drive-rotation member 22 rotates in accordance with the crankshaft in the clockwise direction in FIG. 4, while maintaining the same rotational phase as the crankshaft. The driven-rotation member 24 is coaxially fixed to the camshaft 2 and rotates in the clockwise direction along with the camshaft 2.

As shown in FIGS. 1 and 2, the differential gear mechanism 30 includes a sun gear 31, a planetary carrier 32, a planetary gear 33, and a guide-rotation member 34. The sun gear 31 is an internal gear, which is coaxially fixed to drive-rotation member 22, and rotates along with the drive-rotation member 22 by receiving an output torque of the crankshaft. The planetary carrier 32 is connected to the motor shaft 14 through a joint 35 to rotate along with the motor shaft 14 by receiving the rotation torque from the motor shaft 14. The planetary carrier 32 has an eccentric portion 36 of which outer surface is eccentric with respect to the drive-rotation member 22. The planetary gear 33 is an external gear which is engaged with the eccentric portion 36 through a bearing 37, so that the planetary gear 33 is eccentric with respect to the sun gear 31. The planetary gear 33 engages with the sun gear 31 from its internal side, and performs a planetary motion in accordance with a relative rotation of the motor shaft 14 with respect to the drive-rotation member 22. The guide-rotation member 34 coaxially engages with an outer surface of the driven-rotation member 24. The guide-rotation member 34 is provided with a plurality of engaging holes 38 which are arranged in the rotation direction at regular intervals. The planetary gear 33 is provide with a plurality of engaging protrusions 39 which are engaged with the engaging holes 38, so that a rotational movement of the planetary gear 33 is converted into the rotational movement of the guide-rotation member 34.

Figure 4:
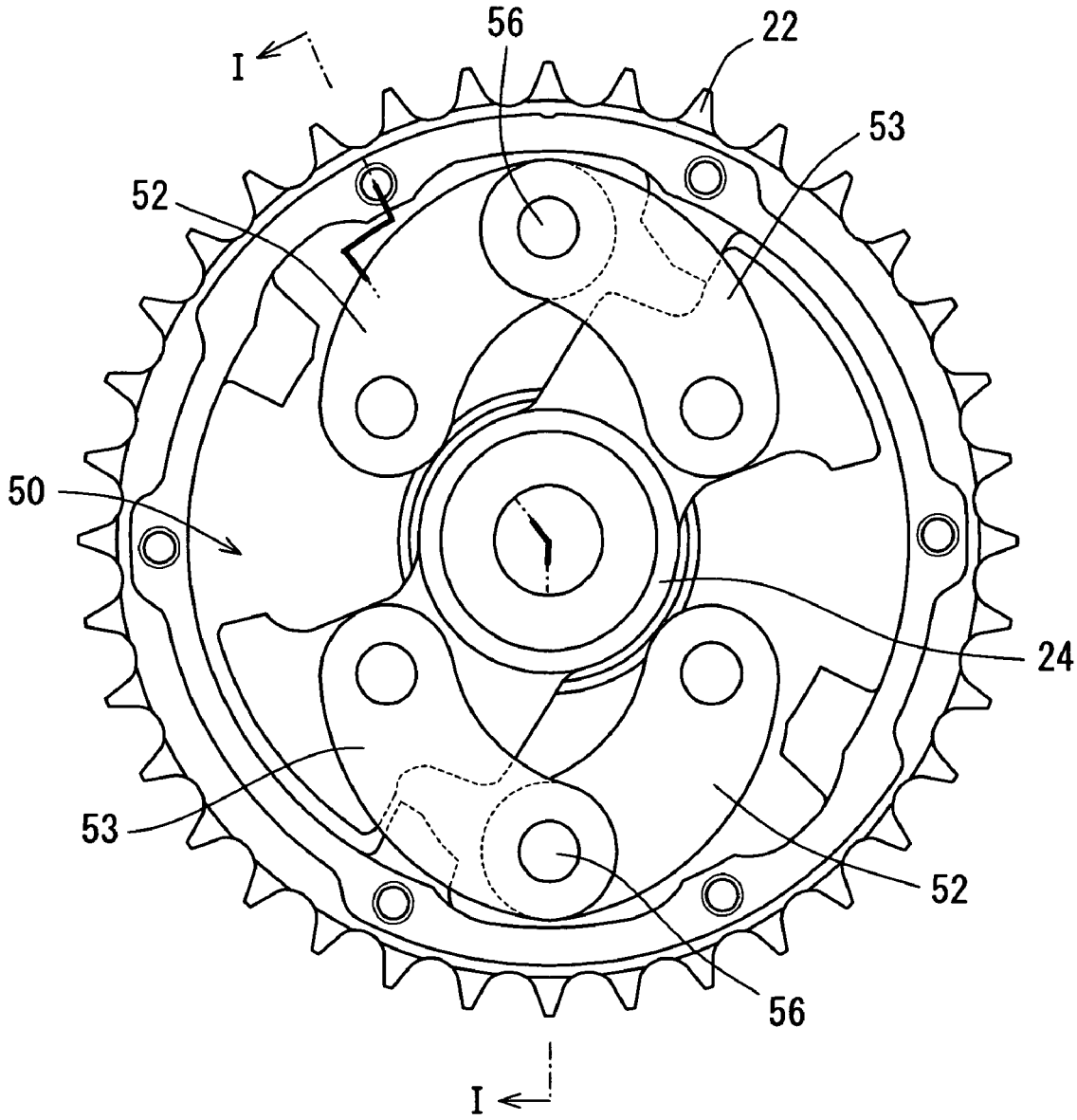
FIG. 4 is a cross sectional view taken along a line IV-IV in FIG. 1.
Figure 5:
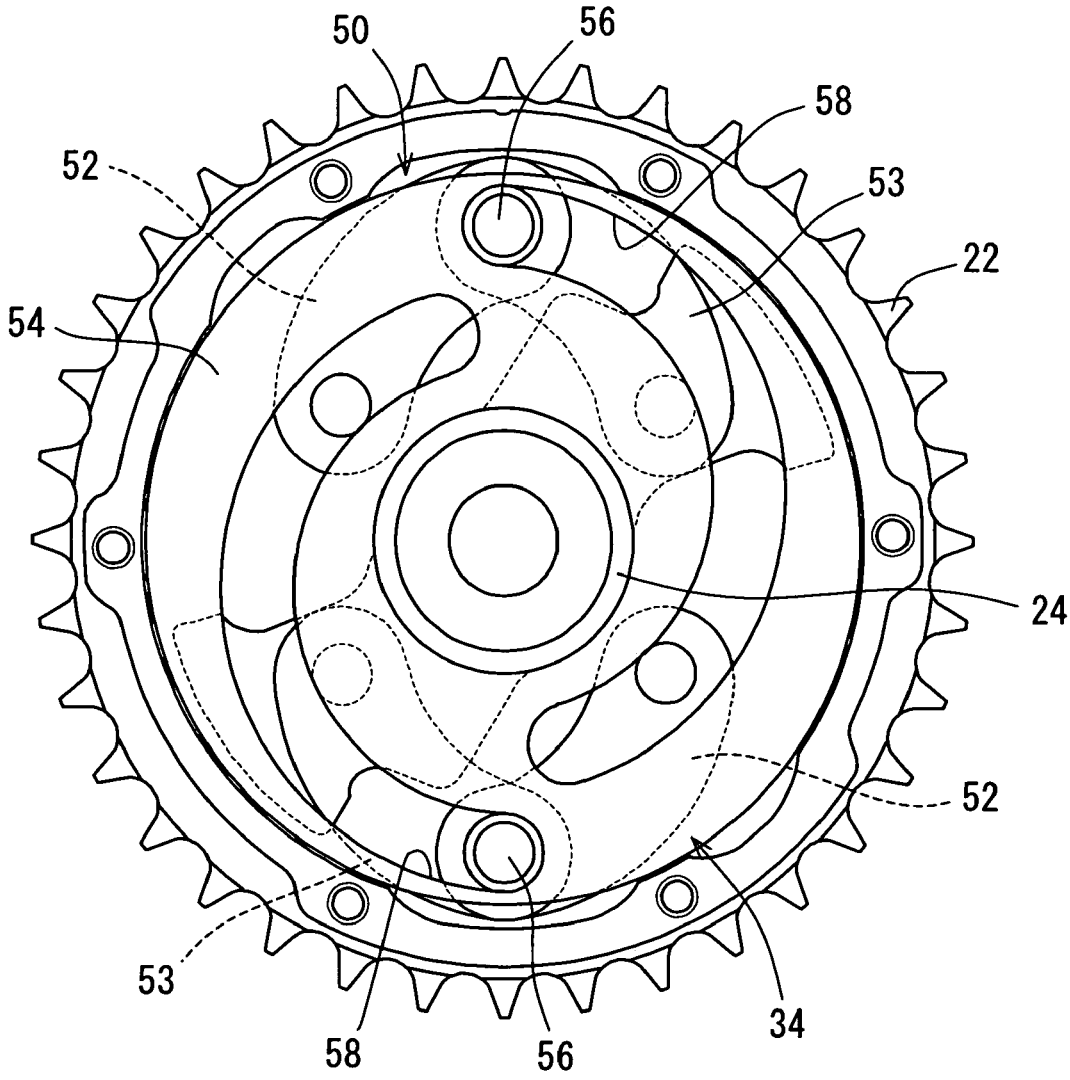
FIG. 5 is a cross sectional view taken along a line V-V in FIG. 1.

As shown in FIGS. 4 and 5, the link mechanism 50 includes a first link 52, a second link 53, a guide portion 54, and a movable member 56. In FIGS. 4 and 5, hatching showing cross sections are not illustrated. The first link 52 is connected to the drive-rotation member 22 by a revolute pair. The second link 53 is connected to the driven-rotation member by a revolute pair and is connected to the first link 52 through the movable member 56. As shown in FIGS. 1 and 5, the guide portion 54 is formed in the guide-rotation member 34 at a side opposite to the planetary gear 33. The guide portion 54 is provided with guide grooves 58 in which the movable member 56 slides. The guide grooves 58 are spiral grooves such that the distance from the rotation center varies along its extending direction.

In a case that the motor shaft 14 does not relatively rotate with respect to the drive-rotation member 22, the planetary gear 33 does not perform the planetary motion so that the drive-rotation member 22 and the guide-rotation member 34 rotates together. As the result, the movable member 56 does not move in the guide groove 58 and the relative position between the first link 52 and the second link 53 does not change, so that the relative rotational phase between the drive-rotation member 22 and the driven-rotation member 24 is maintained, that is, the instant valve timing is maintained. Meanwhile, in a case that the motor shaft 14 relatively rotates with respect to the drive-rotation member 22 in the clockwise direction, the planetary gear 33 performs the planetary motion so that the guide-rotation member 34 relatively rotates with respect to the drive-rotation member 22 in the counterclockwise direction in FIG. 5. As the result, the relative position between the first link 52 and the second link 53 is varied, and the driven-rotation member 24 relatively rotates with respect to the drive-rotation member 22 in the clockwise direction so that the valve timing is advanced. In a case that the motor shaft 14 relatively rotates in the counterclockwise direction, the valve timing is retarded.

Referring to FIG. 3, an electric circuit 60 will be described hereinafter. The electric circuit 60 includes a control circuit 62 and a drive circuit 80. The control circuit 62 is connected to the drive circuit 80 through signal lines 63, 64, 65. The control circuit 62 receives a rotation-direction signal and a rotation-speed signal through the signal lines 63, 64, 65. The rotation-direction signal represents an actual rotation direction D of the motor 12, and the rotation-speed signal represents an actual rotation speed R of the motor 12. The control circuit 62 calculates an actual valve timing based on the rotation-direction signal and the rotation-speed signal, and sets a target valve timing based on the throttle position, an oil temperature, and the like. Furthermore, the control circuit 62 determines a target rotation direction "d" and a target rotation speed "r" of the electric motor 12 based on a differential phase between the actual valve timing and the target valve timing, and generates control signals indicative of "d" and "r". The control signals are transmitted from the control circuit 62 into to the drive circuit 80 through the signal line 65.

The drive circuit 80 includes an electricity controlling part 82 and a signal generating part 84. The electricity controlling part 82 is connected to the signal line 65, and extracts the target rotation direction "d" and the target rotation speed "r". The electricity controlling part 82 is connected to the coil of the motor 12, and controls the voltage applied to the motor 12 based on the target rotation direction "d" and the target rotation speed "r".

Figure 6:
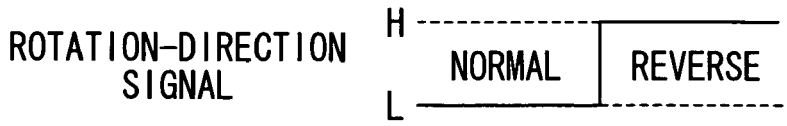
FIG. 6 is a chart for explaining a feature of the electric circuit.

The signal generating part 84 is connected to the rotation angle sensors 16. The signal generating part 84 calculates the actual rotation direction D and the actual rotation speed R based on the sensor signals from the sensors 16. Furthermore, the signal generating part 84 generates the rotation-direction signal indicative of the actual rotation direction D and the rotation-speed signal indicative of the actual rotation speed R. As shown in FIG. 6, a voltage level of the rotation-direction signal varies between high level "H" and low level "L" according to the actual rotation direction D. Specifically, when the actual rotation direction D is normal rotation direction, the voltage level of the rotation-direction signal is set at low level "L". The rotation-direction signal and the rotation-speed signal are transmitted to the control circuit 62 through the signal lines 63, 64. The signal generating part 84 is connected to the signal line 65 to detect a falling edge of the control signal and store the number of its detection.

Figure 7:
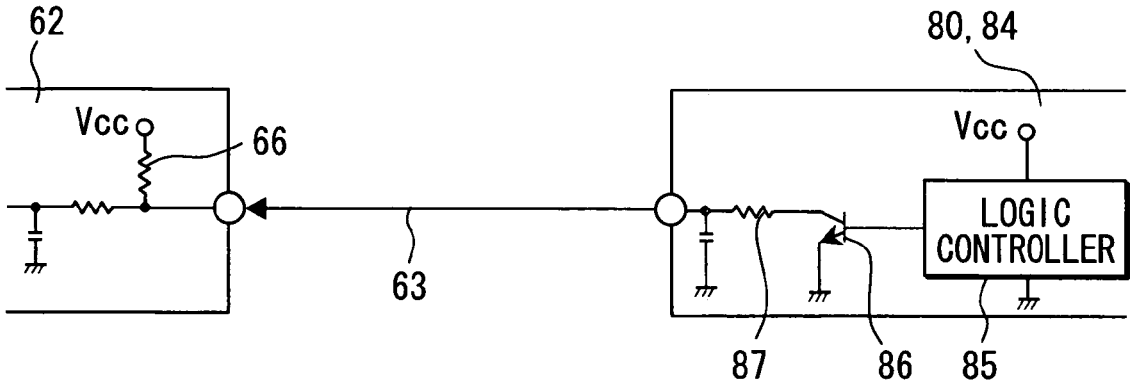
FIG. 7 is a block diagram showing a feature portion of the electric circuit.

As shown in FIG. 7, an active low structure is employed as a transmitting structure of the rotation-direction signal through the signal line 63. In the control circuit 62, the signal line 63 is connected to a power source Vcc through a resistor 66 as a pull-up resistor, so that the active voltage level of the signal line 63 is set to low-level. In the signal generating part 84 of the drive circuit 80, a base of a transistor 86 is connected to a logic controller 85, a collector of the transistor 86 is connected to the signal line 63 through a resistor 87, and an emitter of the transistor 86 is grounded. Hence, when the actual rotation direction D is the normal rotation direction and the logic controller 85 turns on the transistor 86, the signal line 63 is brought to be in the active condition, so that the control circuit 62 determines that the rotation-direction signal of low level is inputted. Meanwhile, when the actual rotation direction D is the reverse rotation direction and the logic controller 85 turns off the transistor 86, the signal line 63 is brought to be in the non-active condition, so that the control circuit 62 determines that the rotation-direction signal of high-level is inputted.

An operation of the electric circuit 60 will be described hereinafter. The control circuit 62 and the drive circuit 80 are energized when the ignition switch is turned on.

Figure 9:
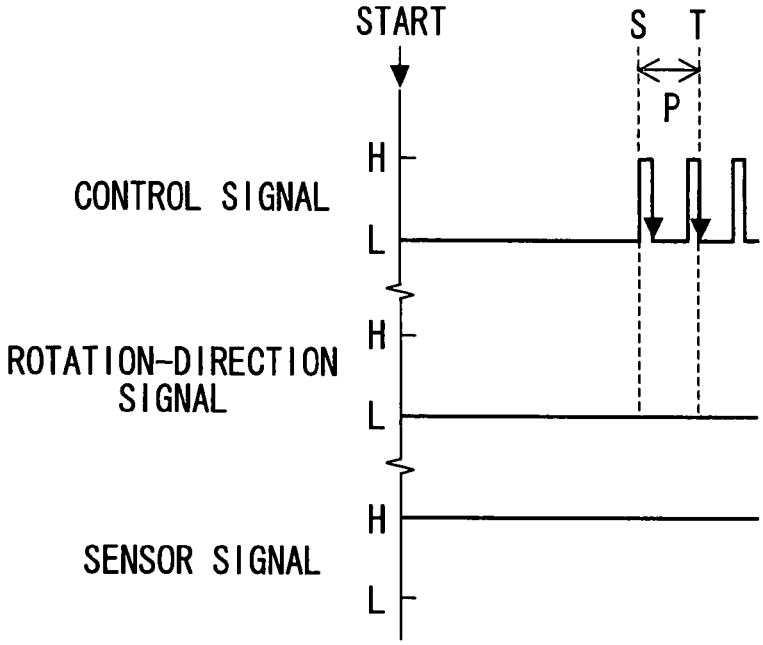
FIG. 9 is a time chart for explaining an operation of the electric circuit.

(1) As shown in FIG. 8, the control circuit 62 generates a predetermined control signal and outputs the control signal into the drive circuit 80. The signal generating part 84 of the drive circuit 80 sets the voltage level of the rotation-direction signal at the high-level in a period P where two falling edges of the control signal are detected from an output starting point S of the control signal. This rotation-direction signal is outputted into the control circuit 62. At this moment, in a case that the signal line 63 is in a ground fault, the signal line 63 is fixed at the active condition, so that the rotation-direction signal of low-level is inputted into the control circuit 62, as shown in FIG. 9. The control circuit 62 determines whether the ground fault exists based on the voltage level of the rotation-direction signal in the period P. That is, in a case that the voltage level of the rotation-direction signal is low-level, the control circuit 62 determines that the ground fault exists and outputs the control signal to stop the electric motor 12. In a case that the voltage level of the rotation-direction signal is high-level, the control circuit 62 determines that no ground fault exists and maintains generating the control signal. The control circuit 62 defines the period P according to the output timing of the control signal.

Figure 10:
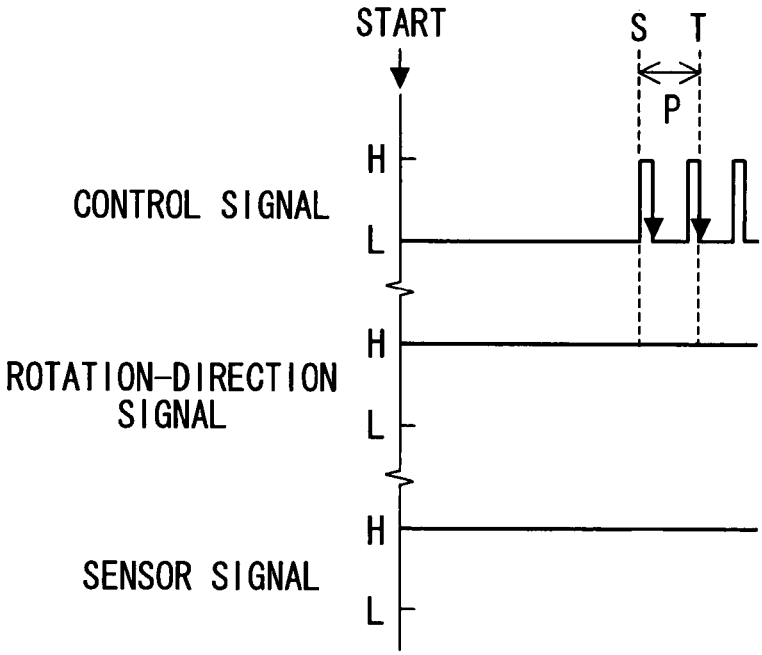
FIG. 10 is a time chart for explaining an operation of the electric circuit.

(2) As shown in FIG. 8, the signal generating part 84 sets the voltage level of the rotation-direction signal at low-level, which is the same level as the active voltage level of the signal line 63, at a time T that is right after the second falling edge is detected. This rotation-direction signal is outputted into the control circuit 62. In a case that the signal line 63 is broken, the signal line 63 is fixed at the non-active condition. Hence, the rotation-direction signal of high-level is inputted into the control circuit 62, as shown in FIG. 10. The control circuit 62 determines whether the brake of signal line exists based on the voltage level of the rotation-direction signal at the time T. In a case that the voltage level of the rotation-direction signal is high-level, the control circuit 62 determines that a brake of signal line exists to stop the electric motor 12. In a case that the voltage level of the rotation-direction signal is low-level, the control circuit 62 determines that no brake of signal line exists to continue generating the control signal. The voltage level of the rotation-direction signal is maintained at low-level from a time of starting energizing the motor 12 until the sensor signals from the rotation angle sensors 16 are inputted into the signal generating part 84. The control circuit 62 identifies the time T according to the output timing of the control signal.

According to the embodiment described above, the ground fault and brake of the signal line 63 can be detected to stop energizing the electric motor 12 and stop valve timing adjustment. Since the ground fault detection is conducted in the period P and the break detection is conducted at the time T, these problems are treated early after the engine is started. Furthermore, since the break detection is conducted after the ground fault detection, it is precisely determined whether the rotation-direction signal of low level at the time T indicates normal condition or the ground fault condition. The ground fault and the break of the signal line 63 can be precisely detected to avoid a trouble in operating the engine.

The present invention is not limited to the above embodiment, and can be applied to various modifications.

For example, an active high structure can be employed as a transmitting structure of the rotation-direction signal through the signal line 63. In this case, the voltage level of the rotation-direction signal is set at high-level during the period P to detect the ground fault. At the time T, the voltage level is set at high-level, which is the same level as the active voltage level of the signal line 63, to detect the break.

The period P can be defined in any period as long as it is after the control signal is outputted. The time T can be defined in any time as long as it is outside of the period P. The ground fault can be omitted without defining the period P and the time T.

What is claimed is:

1. A valve timing controller for an internal combustion engine, the valve timing controller adjusting a valve timing of at least one of an intake valve and an exhaust valve by use of an electric motor, comprising:

a driving circuit for controlling electricity applied to the electric motor according to a control signal, the driving circuit generating a rotation-direction signal which indicates a rotation direction of the electric motor by a voltage level;

a control circuit outputting the control signal which is generated according to the rotation-direction signal; and a signal line for transmitting the rotation-direction signal from the driving circuit to the control circuit, wherein the driving circuit outputs the rotation-direction signal of high-level during a predetermined period after the control signal is outputted.

2. A valve timing controller according to claim 1, wherein the control circuit detects a ground fault in the signal line when the rotation-direction signal of low-level is inputted into the control circuit in the predetermined period.

3. A valve timing controller according to claim 2, wherein the driving circuit sets the voltage level of the rotation-direction signal at the same level as an active voltage level of the signal line at a predetermined timing that is outside the range of the predetermined period.

4. A valve timing controller according to claim 3, wherein the predetermined timing is after the predetermined period has elapsed.

5. A valve timing controller according to claim 3, wherein the active voltage level is low-level.

6. A valve timing controller according to claim 3, wherein the active voltage level is high-level.

7. A valve timing controller according to claim 3, wherein the control circuit detects a break in the signal line when the rotation-direction signal of which voltage level is different from the active voltage level is inputted into the control circuit at the predetermined timing.

8. A valve timing controller according to claim 3, wherein the predetermined timing is after an output of the control signal has been started.

9. A valve timing controller for an internal combustion engine, the valve timing controller adjusting a valve timing of at least one of an intake valve and an exhaust valve by use of an electric motor, comprising:

a driving circuit for controlling electricity applied to the electric motor according to a control signal, the driving circuit generating a rotation-direction signal which indicates a rotation direction of the electric motor by a voltage level;

a control circuit outputting the control signal which is generated according to the rotation-direction signal; and a signal line for transmitting the rotation-direction signal from the driving circuit to the control circuit, wherein the driving circuit sets a voltage level of the rotation-direction signal at the same level as an active voltage level of the signal line at a predetermined timing.

* * * * *